US007149322B2

(12) United States Patent
Kuribayashi et al.

(10) Patent No.: US 7,149,322 B2
(45) Date of Patent: Dec. 12, 2006

(54) MAGNETIC CIRCUIT FOR LOUDSPEAKER AND LOUDSPEAKER COMPRISING IT

(75) Inventors: Ryo Kuribayashi, Mie (JP); Kazuyoshi Umemura, Mie (JP); Hiroyuki Morimoto, Mie (JP); Michitaka Oda, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 582 days.

(21) Appl. No.: 10/468,486

(22) PCT Filed: Jan. 14, 2003

(86) PCT No.: PCT/JP03/00196

§ 371 (c)(1),
(2), (4) Date: Aug. 20, 2003

(87) PCT Pub. No.: WO03/061337

PCT Pub. Date: Jul. 24, 2003

(65) Prior Publication Data

US 2004/0086148 A1 May 6, 2004

(30) Foreign Application Priority Data

Jan. 16, 2002 (JP) ..... 2002-006897

(51) Int. Cl.
*H04R 25/00* (2006.01)

(52) U.S. Cl. ..... 381/412; 381/420

(58) Field of Classification Search ..... 381/150, 381/386, 396, 412, 420
See application file for complete search history.

(56) References Cited

FOREIGN PATENT DOCUMENTS

| | | |
|---|---|---|
| JP | 5-31496 | 4/1993 |
| JP | 5-103393 | 4/1993 |
| JP | 7-264695 | 10/1995 |
| JP | 2001-128287 | 5/2001 |
| JP | 2001-346289 | 12/2001 |

*Primary Examiner*—Curtis Kuntz
*Assistant Examiner*—Tuan Duc Nguyen
(74) *Attorney, Agent, or Firm*—Wenderoth, Lind & Ponack, L.L.P.

(57) ABSTRACT

A magnetic circuit of the present invention uses a yoke, wherein a thickness of a bottom portion 10*b* of the yoke 10 is thicker than a thickness of a cylindrical peripheral portion 10*a* of the yoke 10. The magnetic circuit of the present invention includes the yoke, a magnet 2 bonded to the bottom portion of the yoke, and a top plate 3 bonded to the magnet, the top plate forming a magnetic gap with the cylindrical peripheral portion in between. According to a configuration of the present invention, it is possible to reduce the magnetic saturation in the bottom portion of the yoke and to improve the efficiency of the magnetic circuit. As a result, the configuration contributes to improve the performance and efficiency of a loudspeaker using the magnetic circuit of the present invention.

32 Claims, 4 Drawing Sheets

MAGNETIC CIRCUIT FOR LOUDSPEAKER AND LOUDSPEAKER COMPRISING IT

TECHNICAL FIELD

The present invention relates to a magnetic circuit used in various acoustic apparatus, and a loudspeaker using the magnetic circuit.

BACKGROUND ART

Prior art of similar technology will be described with reference to FIG. 3 and FIG. 4.

FIG. 3 is a half-sectional view showing a configuration of a conventional loudspeaker, and FIG. 4 is an enlarged sectional view of a configuration of a yoke that is an essential component.

In FIG. 3, magnetic circuit A comprises yoke 1 comprising cylindrical peripheral portion 1*a* and bottom yoke 1*b*, magnet 2, and top plate 3. Also, the bottom yoke 1*b* is provided with recess 1*c* at a top surface as shown in an enlarged view in FIG. 4. The recess 1*c* is formed to prevent an adhesive used for bonding the magnet 2 and the bottom yoke 1*b* from getting into magnetic gap 1*d*.

An audio signal is input into voice coil 4 inserted into the magnetic gap 1*d*, to drive diaphragm 6 via the voice coil 4. The diaphragm 6 is held by a peripheral portion fixed on a frame and damper 7.

Generally, the cylindrical peripheral portion 1*a* of the yoke and the bottom yoke 1*b* of the yoke are formed of plate members having the same thickness and are integrally bonded or welded.

Recently, there has been an increasing trend of size-reduction and weight reduction even in in the field of various acoustic apparatus, and loudspeakers are also required to be smaller in size and higher in efficiency. Accordingly, a neodymium magnet having higher magnetic energy as compared with a ferrite magnet is already employed as the magnet 2, but with miniaturization of the magnetic circuit A, loudspeakers are required to be further enhanced in efficiency, and this becomes an important problem to be solved. For enhancing the loudspeaker efficiency, it is indispensable to improve the efficiency of the magnetic circuit.

In a conventional magnetic circuit, as described above, since the yoke is made of materials having the same thickness, magnetic saturation occurs at the bonded portion of the cylindrical peripheral portion 1*a* and the bottom yoke 1*b* and at the bent portion shown in FIG. 4. In order to prevent this problem, the materials for the yoke should have a sufficient thickness in accordance with the characteristics of the magnet. As a result, the yoke is increased in weight. In addition, as the recess 1*c* is formed in the bottom yoke 1*b*, the sectional area of the yoke decreases at this portion, and therefore, it is necessary to use a thicker plate to compensate for the decrease.

The present invention aims to provide a light-weight, high-efficiency magnetic circuit for loudspeakers, and a loudspeaker using the circuit.

DISCLOSURE OF THE INVENTION

A magnetic circuit of the present invention uses a yoke for which an average thickness of a bottom yoke is greater than an average thickness of a cylindrical peripheral portion of the yoke. The magnetic circuit of the present invention comprises the yoke, a magnet bonded to the bottom yoke, and a top plate bonded to the magnet, the top plate forming a magnetic gap with the cylindrical peripheral portion in between. According to the configuration of the present invention, magnetic saturation in the bottom yoke can be decreased, and an efficiency of the magnetic circuit can be increased. The increase of the efficiency contributes to improve characteristics and efficiency of the loudspeaker using the magnetic circuit of the present invention.

DESCRIPTION OF THE PREFERRED EMBODIMENTS

Figure 1:
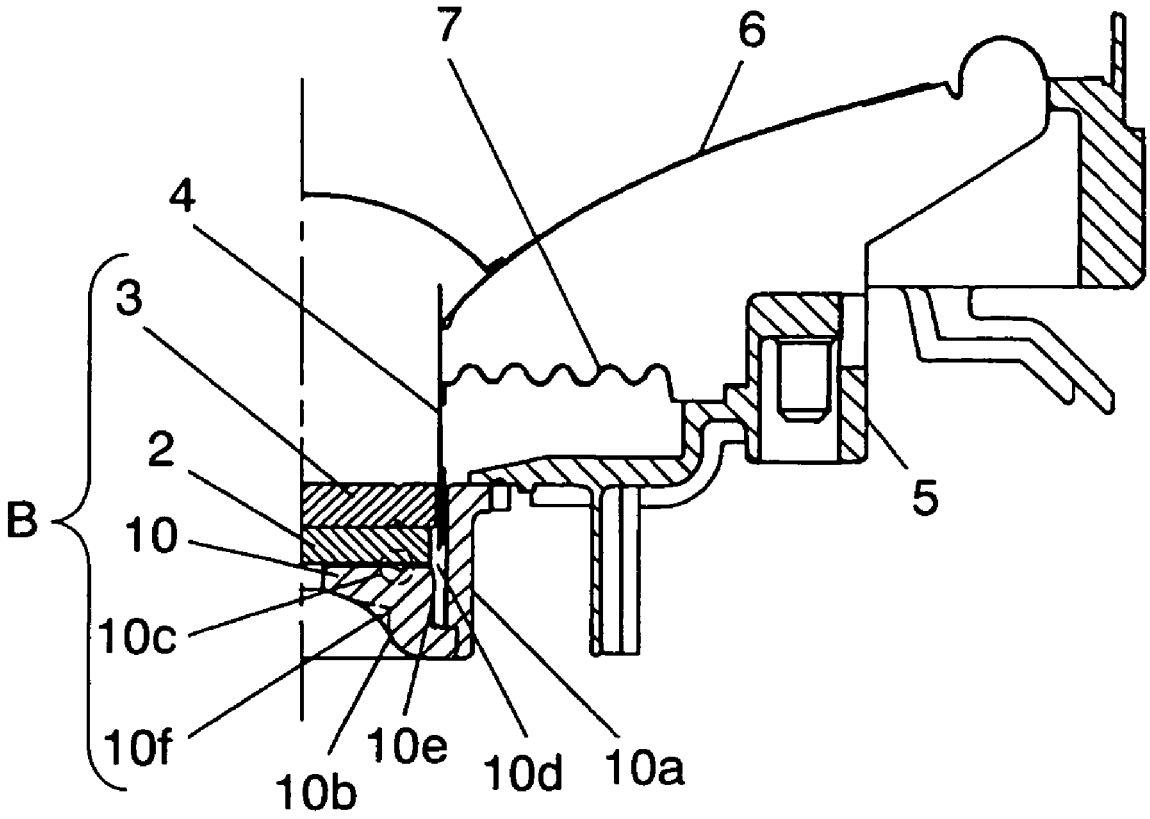
FIG. 1 is a half-sectional side view of a loudspeaker in one embodiment of the present invention.

A magnetic circuit of the present invention uses a yoke for which a thickness of a bottom yoke is greater than a thickness of the cylindrical peripheral portion of the yoke. The magnetic circuit of the present invention comprises the yoke, a magnet bonded to the bottom yoke, and a top plate bonded to the magnet, and the top plate forms a magnetic gap with the cylindrical peripheral portion in between. According to the present invention, it is possible to decrease a magnetic saturation in the bottom yoke and to improve the efficiency of the magnetic circuit. Consequently, usage of the magnetic circuit of the present invention contributes to improve the loudspeaker efficiency.

Also, in another preferred embodiment of the present invention, a yoke is formed as an integrated member in which a bottom portion and a cylindrical peripheral portion are formed as separate members and integrated by caulking. Since the bottom yoke and the cylindrical peripheral portion are formed as separate members, each of them has a simple shape and can be easily manufactured by forging. Accordingly, it is possible to lower the die cost by simplifying the die structure, and to improve productivity.

Also, in the present invention, the bottom yoke is thick enough so that magnetic saturation does not occur at a portion close to a recess provided adjacent to an outer peripheral surface of the yoke. Accordingly, it is possible to avoid generation of magnetic saturation at the peripheral portion of the bottom yoke where magnetic saturation is liable to occur, while preventing the entire bottom yoke from increasing in thickness. As a result, the magnetic efficiency can be improved while suppressing the increase in weight of the magnetic circuit.

Further, in the present invention, a sectional area of the bonded portion of the bottom yoke and the peripheral cylindrical portion is made nearly equal to or larger than a sectional area of the peripheral cylindrical portion to prevent the generation of magnetic saturation in the bottom yoke.

Also, in the present invention, a bent portion of a yoke periphery has a curved surface, eliminating an edge portion at which magnetic saturation is liable to occur. Particularly, an outside portion of a back surface of the recess for preventing adhesive from getting into the magnetic gap is formed by bending. Since the portion at the back of the recess where magnetic saturation is liable to occur is increased in thickness by bending, it is possible to reduce the weight of the magnetic circuit without increasing the thickness of the entire bottom yoke, while avoiding the generation of magnetic saturation.

Further, a loudspeaker of the present invention uses the magnetic circuit of the present invention described above. Thus, it is possible to provide a small-sized, light-weight loudspeaker which assures high sound quality and excellent efficiency.

The preferred embodiments of the present invention will be described in the following with reference to FIG. 1–FIG. 2B. In the description, the same components as those in the prior art are given the same reference numerals, and the description is omitted.

Preferred Embodiment 1

Figure 2A:
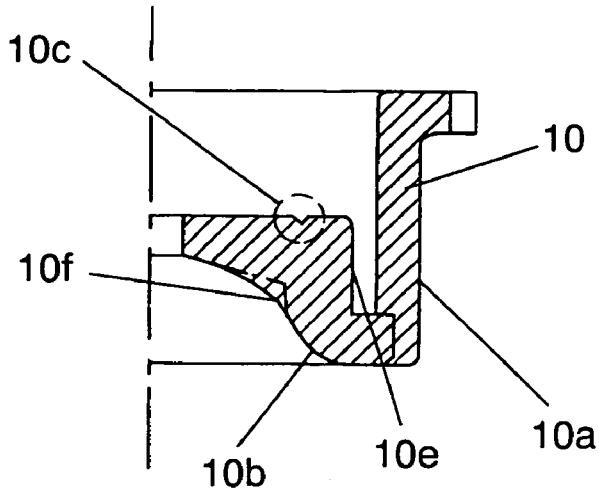
FIG. 2A is an enlarged view of a yoke of the loudspeaker in one embodiment of the present invention.
Figure 2B:
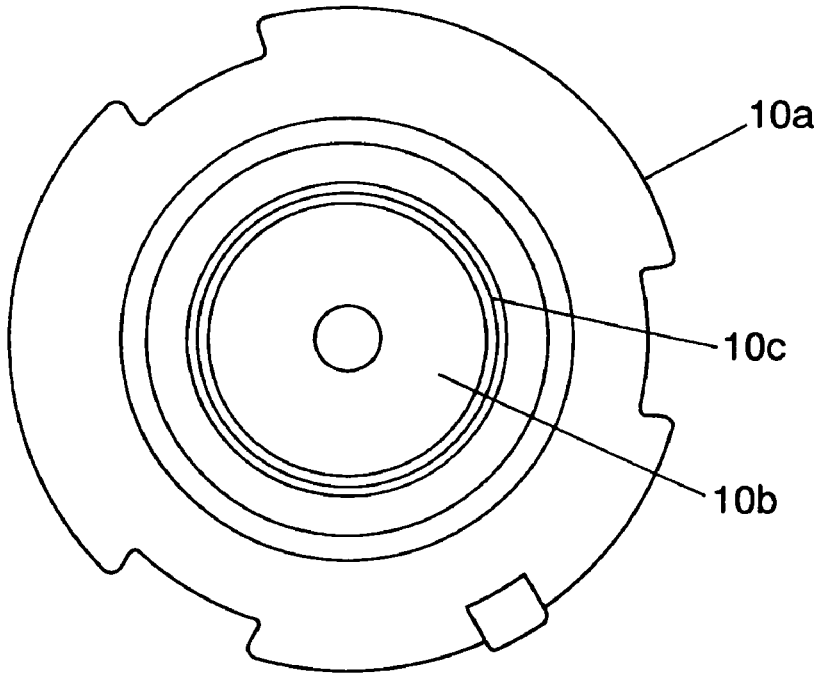
FIG. 2B is a plan view of the yoke.
Figure 3:
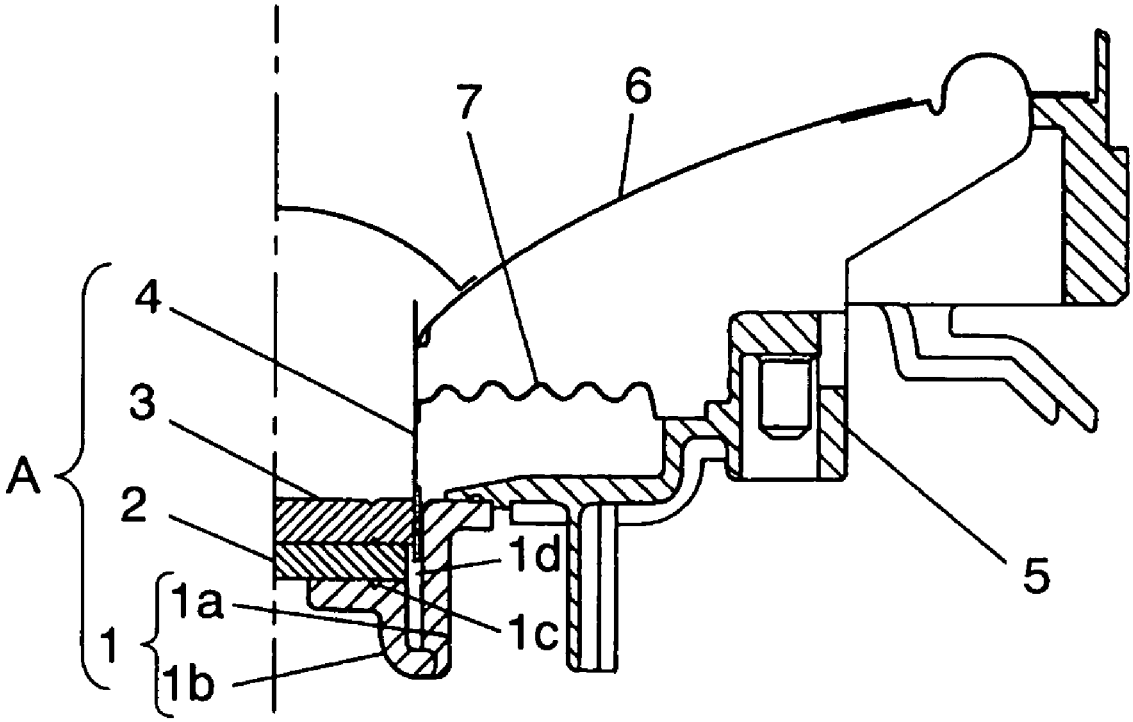
FIG. 3 is a half-sectional side view of a conventional loudspeaker.
Figure 4:
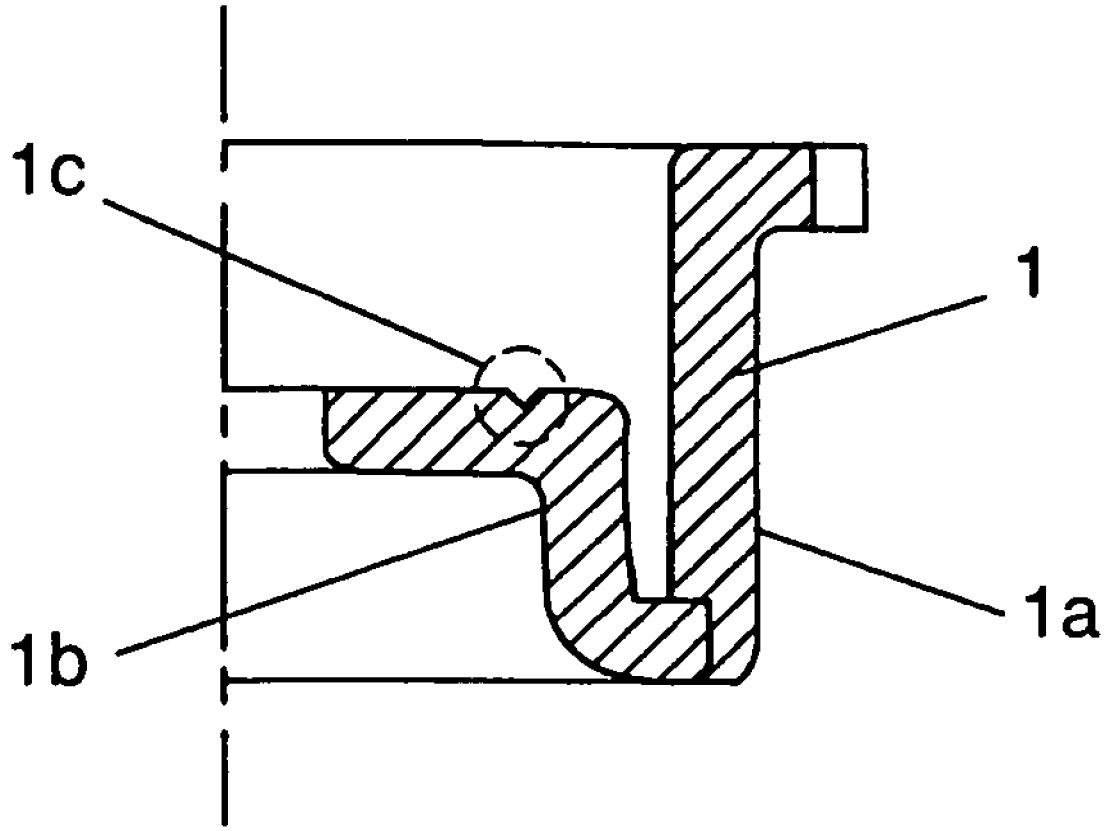
FIG. 4 is an enlarged view showing a configuration of the conventional yoke.

FIG. 1 is a half-sectional view showing a configuration of a loudspeaker in one preferred embodiment of the present invention. FIG. 2A is an enlarged view showing a configuration of a yoke, that is an essential part of the loudspeaker. FIG. 2B is a plan view of the yoke.

Only the differences from the prior art will be described in the following. In the present preferred embodiment, a thickness of cylindrical peripheral portion 10*a* of yoke 10 forming magnetic circuit B is made smaller than a thickness of bottom yoke 10*b*. That is, in the present preferred embodiment, the sectional area of a portion of the bottom yoke 10*b* is such that magnetic flux flow is equal to or larger than that of the cylindrical peripheral portion 10*a*.

To describe it in detail, in the present preferred embodiment, as shown in FIG. 2, the bottom yoke 10*b* at the back surface of recess 10*c* is formed thicker than the other portions in order to prevent magnetic saturation in the bottom yoke 10*b* below the recess 10*c*.

As described earlier, the recess 10*c* has a ring shape so as to prevent adhesives used to bond the magnet 2 and the bottom yoke 10*b* from getting into the magnetic gap 10*d*. It is desirable, considering production cost, to form the recess 10*c* simultaneously when the bottom yoke 10*b* is forged, but magnetic permeability of the bottom yoke 10*b*, a magnetic material, may be deteriorated due to forging compression. In that case, the deterioration of magnetic permeability causes the generation of magnetic saturation around a portion below the recess 10*c*. In order to prevent this, the thickness of the bottom yoke 10*b* is made equal to or greater than the thickness of the cylindrical peripheral portion 10*a*, assuring a thickness sufficient to prevent the generation of magnetic saturation at a portion below the recess 10*c*, and further, it is intended to improve the magnetic efficiency.

Also, in the present preferred embodiment, the bottom yoke 10*b* and the cylindrical peripheral portion 10*a* are integrated by caulking, thereby preventing the lowering of magnetic efficiency. Further, an area of the bonded portion of the bottom yoke 10*b* and the cylindrical peripheral portion 10*a* is nearly the same as the sectional area of the cylindrical peripheral portion 10*a*, thereby preventing the lowering of magnetic efficiency.

Also, the bottom yoke 10*b* has side wall 10*e* to assure a sufficient height so that voice coil 4 is not damaged by a collision with the bottom yoke 10*b* due to a large amplitude of the voice coil 4 when a high level of input is applied to the loudspeaker. A thickness of a portion of the bottom yoke 10*b* connecting to the side wall 10*e* is also made thick enough to make a sectional area equal to or larger than the sectional area of the cylindrical peripheral portion 10*a*. Thus, the magnetic saturation in the side wall portion is prevented and the magnetic efficiency is improved.

Further, in the present preferred embodiment, yoke 10 is configured in that bend portion 10*f* at the periphery of the bottom yoke 10*b* has a curved surface to improve the magnetic efficiency, and the bend portion 10*f* is positioned below the recess 10*c*. According to this configuration, it is not necessary to increase the thickness of the bottom yoke 10*b* excessively in order to prevent the magnetic saturation in a portion below the recess 10*c*. As a result, it is possible to provide a magnetic circuit improved in efficiency while suppressing the increase of yoke weight.

To confirm the effects of the present invention, loudspeakers were manufactured according to the conventional technology and the present preferred embodiment and compared. The voice coil of the loudspeaker is 25 mm in diameter, and the loudspeaker is 16 cm in diameter. The results of measurements of the magnetic flux density and sound pressure level of each of the loudspeakers manufactured are shown in Table 1.

TABLE 1

| | Present invention | conventional technology |
|---|---|---|
| Magnetic flux density (Tesra) | 0.835 | 0.797 |
| Sound pressure level (dB) | 87.0 | 86.5 |

As is apparent from Table 1, as compared with the loudspeaker of conventional structure, with the loudspeaker of the present invention, increases of the magnetic flux density and sound pressure level are observed, and it has been confirmed that it is possible to provide a loudspeaker with a magnetic circuit of higher magnetic efficiency and also improved in sound pressure level.

In the above description, an example where the yoke is separated into a bottom portion and a cylindrical peripheral portion is described. However, it is also possible to integrally form the yoke by casting, forging or cutting in order to prevent the magnetic saturation in the bonded portion of the bottom yoke 10*b* and the cylindrical peripheral portion 10*a* and to form a further high-efficiency magnetic circuit.

As described above, in the present preferred embodiment, it is possible to provide a magnetic circuit enhanced in magnetic efficiency, but it is not always necessary to employ all of the various means or configurations mentioned above. It is preferable to improve the magnetic efficiency by properly selecting some of the configurations in accordance with the shape of the intended loudspeaker and the like.

INDUSTRIAL APPLICABILITY

As described above, the magnetic circuit of the present invention and the loudspeaker using the magnetic circuit have the sectional area of magnetic flux flowing portion of the bottom yoke equal to or larger than the sectional area of the cylindrical peripheral portion of the yoke. By using the configuration of the present invention, it is possible to obtain a magnetic circuit of high efficiency by reducing the magnetic saturation due to the differences in sectional areas of different portions of the yoke, and also, to provide a high-output, small-sized, and light-weight loudspeaker by using the magnetic circuit.

The invention claimed is:

1. A magnetic circuit for a loudspeaker, comprising:

a yoke having a bottom portion and an outer cylindrical portion;

a magnet bonded to said bottom portion of said yoke; and a top plate bonded to said magnet, a magnetic gap being formed between said top plate and said outer cylindrical portion;

wherein a thickness of said bottom portion is greater than a thickness of said outer cylindrical portion; and wherein a recess is formed in a surface of said bottom portion facing said magnet in a location radially inwardly of said magnetic gap for preventing adhesive used for bonding said magnet to said bottom portion from getting into said magnetic gap.

2. The magnetic circuit of claim 1, wherein said bottom portion and said outer cylindrical portion are formed as separate members.

3. The magnetic circuit of claim 2, wherein said bottom portion and said outer cylindrical portion are bonded by crimping.

4. The magnetic circuit of claim 1, wherein a thickness of said bottom portion adjacent said recess along an axial direction is thicker than other portions of said bottom portion.

5. The magnetic circuit of claim 1, wherein a sectional area of a bonded portion of said bottom portion and said outer cylindrical portion is equal to or larger than a sectional area of said outer cylindrical portion.

6. The magnetic circuit of claim 1, wherein a sectional shape of a bent portion of an outer periphery of said bottom portion is curved.

7. The magnetic circuit of claim 1, wherein said bottom portion has a curved surface on a back surface thereof opposite where said recess is provided.

8. A loudspeaker comprising:

(a) a magnetic circuit comprising a yoke having a bottom portion and an outer cylindrical portion, a magnet bonded to said bottom portion of said yoke, and a top plate bonded to said magnet, a magnetic gap being formed between said top plate and said outer cylindrical portion;

(b) a voice coil held in said magnetic gap; and (c) a diaphragm having an inner periphery bonded to said voice coil and an outer periphery bonded to a frame;

wherein a thickness of said bottom portion is greater than a thickness of said outer cylindrical portion; and wherein a recess is formed in a surface of said bottom portion facing said magnet in a location radially inwardly of said magnetic gap for preventing adhesive used for bonding said magnet to said bottom portion from getting into said magnetic gap.

9. The loudspeaker of claim 8, wherein said bottom portion and said outer cylindrical portion are formed as separate members.

10. The loudspeaker of claim 8, wherein said bottom portion and said outer cylindrical portion are bonded by crimping.

11. The loudspeaker of claim 8, wherein a thickness of said bottom portion adjacent said recess along an axial direction is thicker than other portions of said bottom portion.

12. The loudspeaker of claim 8, wherein a sectional area of a bonded portion of said bottom portion and said outer cylindrical portion is equal to or larger than a sectional area of said outer cylindrical portion.

13. The loudspeaker of claim 8, wherein a sectional shape of a bent portion of an outer periphery of said bottom portion is curved.

14. The loudspeaker of claim 8, wherein said bottom portion has a curved surface on a back surface thereof opposite where said recess is provided.

15. The magnetic circuit of claim 2, wherein a thickness of said bottom portion adjacent said recess along an axial direction is thicker than other portions of said bottom portion.

16. The magnetic circuit of claim 3, wherein a thickness of said bottom portion adjacent said recess along an axial direction is thicker than other portions of said bottom portion.

17. The magnetic circuit of claim 2, wherein a sectional area of a bonded portion of said bottom portion and said outer cylindrical portion is equal to or larger than a sectional area of said outer cylindrical portion.

18. The magnetic circuit of claim 3, wherein a sectional area of a bonded portion of said bottom portion and said outer cylindrical portion is equal to or larger than a sectional area of said outer cylindrical portion.

19. The magnetic circuit of claim 2, wherein a sectional shape of a bent portion of an outer periphery of said bottom portion is curved.

20. The magnetic circuit of claim 3, wherein a sectional shape of a bent portion of an outer periphery of said bottom portion is curved.

21. The magnetic circuit of claim 2, wherein said bottom portion has a curved surface on a back surface thereof opposite where said recess is provided.

22. The magnetic circuit of claim 3, wherein said bottom portion has a curved surface on a back surface thereof opposite where said recess is provided.

23. The loudspeaker of claim 9, wherein a thickness of said bottom portion adjacent said recess along an axial direction is thicker than other portions of said bottom portion.

24. The loudspeaker of claim 10, wherein a thickness of said bottom portion adjacent said recess along an axial direction is thicker than other portions of said bottom portion.

25. The loudspeaker of claim 9, wherein a sectional area of a bonded portion of said bottom portion and said outer cylindrical portion is equal to or larger than a sectional area of said outer cylindrical portion.

26. The loudspeaker of claim 10, wherein a sectional area of a bonded portion of said bottom portion and said outer cylindrical portion is equal to or larger than a sectional area of said outer cylindrical portion.

27. The loudspeaker of claim 9, wherein a sectional shape of a bent portion of an outer periphery of said bottom portion is curved.

28. The loudspeaker of claim 10, wherein a sectional shape of a bent portion of an outer periphery of said bottom portion is curved.

29. The loudspeaker of claim 9, wherein said bottom portion has a curved surface on a back surface thereof opposite where said recess is provided.

30. The loudspeaker of claim 10, wherein said bottom portion has a curved surface on a back surface thereof opposite where said recess is provided.

31. The loudspeaker of claim 8, wherein said magnet is bonded to said bottom portion such that an axially-facing surface of said magnet opposes and covers said recess.

32. The magnet circuit of claim 1, wherein said magnet is bonded to said bottom portion such that an axially-facing surface of said magnet opposes and covers said recess.

* * * * *